United States Patent [19]

Goncalves

[11] 4,203,172

[45] May 20, 1980

[54] SUPPORT FOR TOILET BOWL DEODORIZER BLOCK

[75] Inventor: Antonin Gonçalves, Groslay, France

[73] Assignee: L'Oreal, Paris, France

[21] Appl. No.: 912,748

[22] Filed: Jun. 5, 1978

[30] Foreign Application Priority Data

Jun. 20, 1977 [FR] France ..... 77 18865

[51] Int. Cl.[2] ..... A61L 3/00; B01J 4/00; E03D 9/02

[52] U.S. Cl. ..... 4/231; 4/222.1; 220/87; 248/94; 422/263; 422/266; D23/3

[58] Field of Search ..... 422/5, 263, 266; 4/222.1, 222, 231, 294, 232; 220/95, 96, 94 A, 87, 18; 248/94, 166, 168, 360; D23/3, 69

[56] References Cited

U.S. PATENT DOCUMENTS

| | | | |
|---|---|---|---|
| 1,210,650 | 1/1917 | Hunt | 4/231 |
| 3,088,126 | 5/1963 | Klingler | 4/231 |
| 3,675,254 | 7/1972 | Brownstein | 4/231 |
| 4,143,431 | 3/1979 | Goncalves | 220/94 A |

FOREIGN PATENT DOCUMENTS

| | | | |
|---|---|---|---|
| 2255161 | 8/1973 | Fed. Rep. of Germany | 4/231 |
| 2200414 | 4/1974 | France | 4/231 |
| 2258320 | 8/1975 | France | 4/231 |
| 2293533 | 7/1976 | France . | |
| 1255877 | 12/1971 | United Kingdom . | |

OTHER PUBLICATIONS

Research Disclosure; No. 118; p. 5; 2-1974.

*Primary Examiner*—Bradley R. Garris
*Attorney, Agent, or Firm*—Brisebois & Kruger

[57] ABSTRACT

A support for a cylindrical block of deodorizer product is in the form of a cylindrical cage formed of two identical parts each of which has a cylindrical shape with a closed end and an open end defined by an end collar, the end collars of the two parts being interengageable by means of male and female engagement means carried by both end collars for rendering the two cage parts integral as a single cylindrical cage.

The suspension hook is integrally formed with a connection sleeve which has a larger diameter portion capable of engaging on the end collars of the two cage halves and a smaller diameter portion capable of engaging on and sliding along either cage half over a portion other than the said end collar thereof and the narrower diameter portion includes catch engagement means for permitting sliding engagement of the connecting sleeve along the cage in one direction only.

12 Claims, 8 Drawing Figures

FIG.6
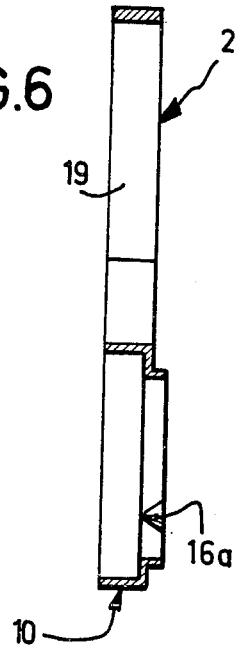
FIG.4
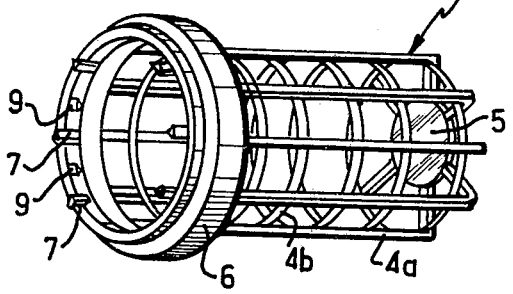
FIG.3
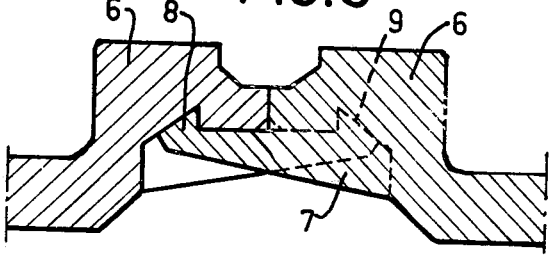
FIG.7
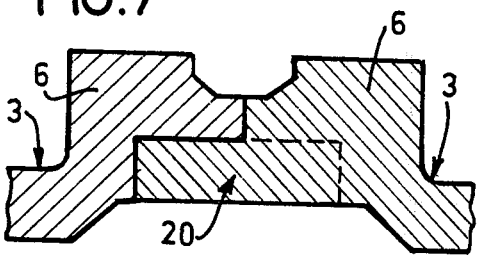
FIG.8
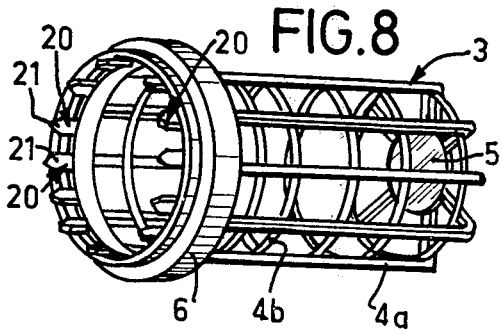
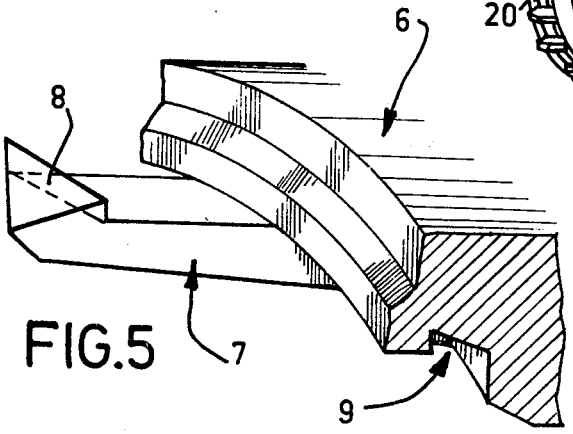
FIG.5

SUPPORT FOR TOILET BOWL DEODORIZER BLOCK

It is known, for disinfecting and deodorising toilet pans, to hook to the edge of the pan a support constituted by the assembly of both a cage containing a stick of a suitable product and an attached hook to be displayed by the user.

In a known embodiment, the cylindrical cage is constituted by two half cages which are assembled together by two end collars arranged in the transverse central plane of the cage. The two half cages may be fixed to each other by means of a catch engagement of a bead arranged on one of the collars of the two half cages within a corresponding groove provided on the other end collar. The two end collars define between themselves, after fixing of the two half cages, a peripheral groove within which an attached suspension hook is engaged.

This system has two disadvantages. First of all, since the cage is subjected to the action of the flushing water it is liable to unhooking in use if the suspension hook has not been deployed correctly.

Accordingly the present invention provides a support for a block of a product for the disinfection and/or deodorisation of a toilet pan comprising on the one hand a foraminous cage for such a block; and on the other hand a hook attached to the cage in the central zone thereof to enable the cap to be suspended on the edge of a toilet pan, the suspension hook being made as a single component with an integral connection sleeve capable of being fitted around the assembled cage, securing of the said connection sleeve to the cage being effected on the one hand by means of a rim provided in relief in the central zone of the cage, and on the other hand by catch engagement means provided in relief on the inner wall of the connection sleeve to engage within an opening in the foraminous wall of the cage and shaped so as to allow the connection sleeve to slide along the cage in one direction but to hold the sleeve against movement along the cage in the opposite direction.

Since the relief rim serves as an abutment stop in the central zone of the cage and the connection sleeve can in any case only move along the cage in one direction, there is a practically non-dismantleable connection between the cage and its associated hook and the support is securely held against the impact force of the flushing water, no severance being allowed to occur between the suspension hook and the cage.

Conventionally it has been necessary to manufacture two different models of the half cages, i.e. one model whose end collar comprises a catch bead and another whose collar comprises a corresponding groove to ensure the fixing of the two half cages. In this case, it is therefore necessary to mould three separate elements, that is to say, one separate suspension hook, one half cage comprising a male fixing device and another comprising a female fixing device; this complicates the manufacture of the support and makes it relatively expensive.

In order to overcome this disadvantage, the cage of the support is preferably made in two identical parts each comprising both male and female devices. It follows that the support may thus be obtained merely by the moulding of two components of different types, that is to say, a hook adjoining the connection sleeve and twice the quantity of a single type of cage half carryng both male and female catch engagement devices.

The catch engagement means of the connection sleeve may be in the form of at least one ramp extending parallel to the axis of the sleeve. The back of the ramp can be arranged substantially perpendicularly to the axis of the connection sleeve so that when the ramp is engaged in one of the openings of the foraminous cage, the back of the ramp opposes a displacement of the sleeve in one direction along said cage.

In a preferred embodiment, the cage of the support according to the invention is substantially cylindrical and the rim extends peripherally at the central transverse plane of the said cage; the cage is constituted by two cage halves whose plane of juncture substantially corresponds to the central transverse plane of the cage; the peripheral rim is formed by the joining of the two end collars of the assembled cage halves; the side wall of each cage half is formed by bars arranged parallel to the longitudinal axis of the cage and by coaxial rings arranged perpendicularly to said longitudinal axis; the catch engagement devices of the connecting sleeve, once the latter is positioned on the cage, being engaged in openings bounded by the end collar of one cage half and by the ring which is adjacent to it; the connecting sleeve is of a generally cylindrical shape and comprises two parts with different diameters connected by a shoulder, the sleeve part with the greater diameter being arranged to cover said peripheral rim of the cage when the connecting sleeve is positioned on the cage and the sleeve part with the smaller diameter comprising internally said catch engagement means; the suspension hook is constituted by a movable U-shaped part one of whose two arms is articulated to the connection sleeve by means of a thin film hinge derived from moulding; the end of the other arm of the U formed by the suspension hook is connected to the connecting sleeve by a rupturable fastening obtained by moulding.

Particularly advantageously the two half cages are identical and each comprises connecting means, attachment fingers fitted with catch engagement hooks and an equal number of cutouts of complementary shape arranged on the inner wall of the end collar. The attachment fingers extend parallel to the axis of the corresponding cage half and project via the end collar outside the said cage half; each cage half alternately presents attachment fingers and cutouts which are regularly interspaced around the circumference of the end collar. In a variant of this mode of fixing the two cage halves, each of them comprises as connection means an identical number of self-blocking attachment fingers such that each attachment finger of one of the cage halves can engage itself between two adjacent attachment fingers of the other cage half.

In order that the present invention may more readily be understood, one embodiment represented on the accompanying drawing will be described below by way of a purely illustrative and non-restrictive example.

In these drawings:

FIG. 3 is an axial cross section of a detail of the first way of interfixing the two half cages shown in FIG. 2;

FIG. 4 represents a perspective view of one of the half cages which are fitted with assembly devices corresponding to this first way of interfixing;

FIG. 5 is a perspective view on an enlarged scale of a detail of the fixing devices of the half cage of FIG. 4;

FIG. 6 is a cross section along line VI–VI of the suspension hook of FIG. 2;

FIG. 7 is an axial cross section of a detail of a second way of interfixing the two half cages of FIG. 2; and FIG. 8 is a perspective view of one of the two half cages fitted with the assembly devices corresponding to this second way of interfixing.

Figure 1:
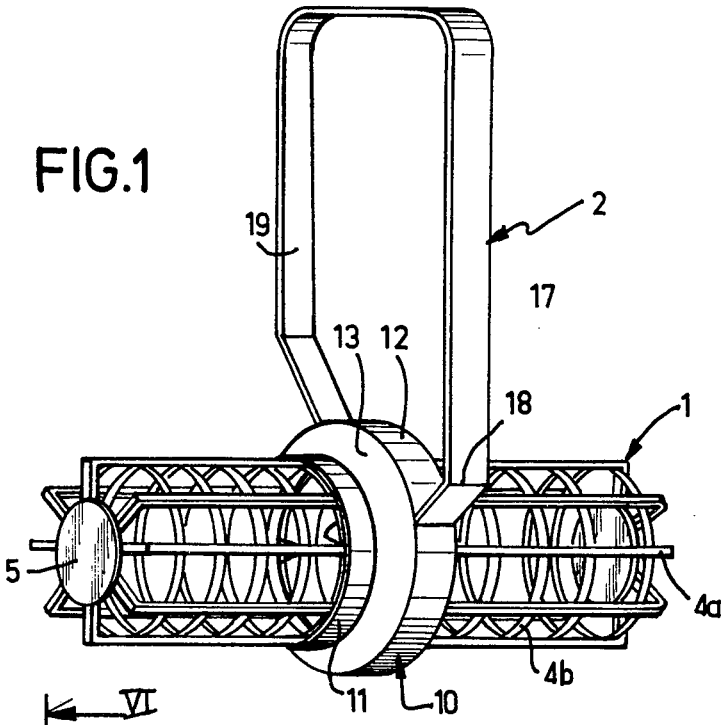
FIG. 1 represents a perspective view of a support according to the invention in a position of use, the deodorant stick which is intended to be contained in the cage having been omitted.

Referring now to the drawings, there will be seen a support constituted by the assembly of a cage 1 intended to contain a stick of a disinfectant/deodorant product and an attached suspension hook 2 to be deployed by the user.

Cage 1 exhibits the special feature of being made of two strictly identical parts 3, so that the cage 1 has a general cylindrical shape and comprises a set of bars **4*a* which are parallel to its axis and are connected at each end of the cage 1 to an end disc 5 and, in the zone of the transverse centre plane of the cage, to one of the two end collars 6 carried by each half cage. Cage 1 is also fitted with coaxial rings 4*b*** which are regularly spaced along the cage and arranged perpendicularly to the axis of the said cage.

The end collar 6 of each half cage 3 forms an annular rim projecting radially outwardly in relation to the perforated side wall of the half cage 3.

It is an advantageous characteristic that, each of the half cages 3 comprises both male and female interfixing devices. Because of this, the two half cages 3 may present exactly the same design and be moulded in a common mould, in contrast to the prior art model acknowledged above where the two cage halves were not identical, because one comprised a female fixing device and the other a corresponding male device which, of course, had the inconvenience of requiring the use of two different moulds.

With a first way of fixing the two half cages 3 together, each of them comprises six catch fingers 7 (see FIGS. 3 to 5) fitted at their free end with a catch engagement tooth 8. The catch fingers 7 are substantially parallel to the axis of the half cage; they are arranged within the end collar 6 and project from the half cage 3. The corresponding female engagement devices are constituted by cutouts 9 in the radially inner wall of the two end collars 6 of the half cages; the cutouts 9 and the catch engagement teeth 8 which they are intended to accommodate are complementary in shape. As may be seen in FIG. 4, each half cage is provided with six catch engagement fingers 7 arranged alternately with six cutouts 9, the fingers 7 and cutouts 9 being regularly interspaced around the circumference of end collar 6. Thus the two half cages 3 may be interfixed to each other by virtue of the teeth end parts 8 of the fingers 7 of one of the half cages 3 engaging as a snap-fit in the cutouts provided for this purpose in the other half cage.

Figure 2:
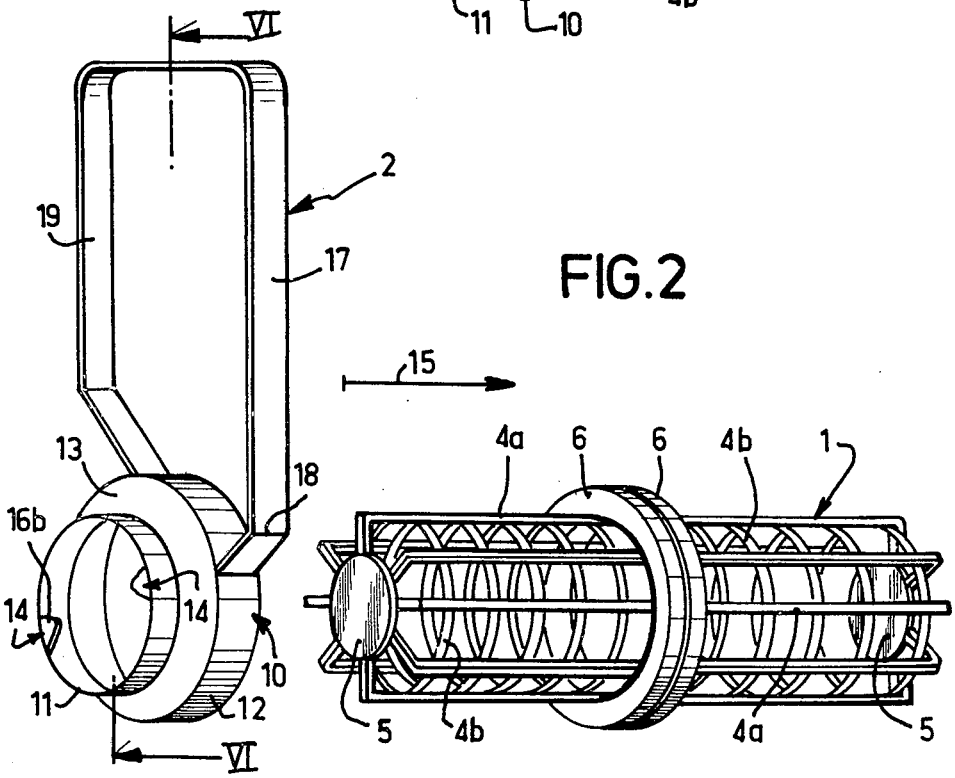
FIG. 2 is a perspective view of the cage and the associated suspension hook before their assembly.

As may be seen in FIG. 2 of the drawing, the joint of the two end collars 6 constitutes an annular projecting rim arranged in the central transverse plane of cage 1.

With a second way of interfixing of the two half cages 3 (illustrated in FIGS. 7 and 8), each one of the half cages comprises twelve self-locking engagement fingers 20 such that each of the fingers 20 of one half cage come to engage between two adjacent fingers provided on the other half cage. the self-locking engagement fingers 20 are provided in relief within the end collar 6 of each half cage. These fingers 20 are regularly interspaced; they extend parallel to the generatrices of the circular inner wall of end collar 6 and project outside from the half cage. The self-locking engagement fingers 20 have a slightly bulbous end zone 21 terminating in a point to facilitate its insertion between two adjacent engagement fingers when the two half cages 3 are joined.

Thus in this second way of interfixing, the female connecting devices are bounded by the notch which separates two successive self-locking engagement fingers 20. This second way of interfixing exhibits relative to the first way described above, a simplification of the moulding operation, since it is no longer necessary to provide in the inner wall of the end collar 6, the cutouts 9 to serve as female connecting devices.

The suspension hook 2 intended to be connected to the cage 1 has a fixed part constituted by a connection sleeve 10 and a U-shaped movable part constituting the hook proper. The connection sleeve 10 is of a generally cylindrical shape and comprises two sections 11, 12, with different diameters but joined by an intermediate zone forming a shoulder 13. The connection sleeve 10 is capable of being fitted on cage 1 and to do this, the smaller diameter section 11 of the sleeve has an internal diameter which is only slightly larger than the outer diameter of the perforated wall of cage 1.

On the inner wall of smaller diameter section 11 of the connection sleeve are, in relief, two catch studs 14 diametrically opposed to each other. The two catch studs 14 are capable of being engaged, during the assembly of sleeve 10, on cage 1 within an opening formed by the intersection of the two bars **4*a* with two rings 4*b* adjacent to the side wall of the cage. The two engagement studs 14 are designed so that they allow sliding of the connection sleeve of cage 1 only in a signle direction, (indicated by arrow 15 on FIG. 2 of the drawing). Each engagement stud has, for this purpose, parallel to the axis of the sleeve, a triangular profile, one of whose surfaces 16*a* (FIG. 6) is sloping to form with the sleeve axis an acute angle of inclination whose apex is towards the side of the smaller diameter section 11 of the connection sleeve 10. Thus, in the direction of mounting indicated by arrow 15, the catch engagement studs fulfil, thanks to their sloping surface 16*a*, the function of a sliding ramp. On the other hand, upon movement in the direction opposite to that of arrow 15, when sleeve 10 is fitted on cage 1 catch engagement studs 14 come to abut against the rings 4*b* by their face 16*b* which extends substantially perpendicularly to the sleeve axis, that is to say, whose inclination is near 90°** in relation to the said axis.

Moreover, the two catch engagement studs 14 define by reason of their particular profiles, a single correct assembly position for the suspension hook in relation to the cage 1. In fact, in the absence of any engagement stud 14, the connection sleeve 10 could be fitted on the cage 1 either by its section 12 with the greater diameter, or by its smaller diameter section 11. In this embodiment, the fitting of connection sleeve 10 can only be effected by its surface with the larger diameter since, if the latter were to be presented in a reverse way, it could not be mounted on the cage because of the presence of the engagement studs 14.

The deployment of suspension hook 2 on the cage 1 is as follows

The connection sleeve 10 is presented to the cage 1 with its larger diameter face exposed to the shoulder 13 of the sleeve 10 and is slid along the cage 1 until the shoulder 13 abuts against the central rim formed by the join of the two end collars 6 of half cages 3. To accommodate this, the rings **4*b* may be deformed radially inwardly by camming engagement with the ramps 16*a* of the engagement stud of the connection sleeve. The two engagement studs 14 are then engaged in the openings formed on the one hand by the two adjacent bars 4*a* and on the other hand, by the edge of an end collar 6 and the ring 4*b* adjacent to it. The connection sleeve 10 is then locked against movement in the mounting direction (indicated by arrow 15) by means of the central rim of the cage, and in the opposite direction by the engagement catch studs 14 which are stopped by ring 4*b* adjacent to one of the end collars 6. As is shown in FIG. 1, the larger diameter section 12 of the connection sleeve 10 entirely surrounds the two end collars 6 forming the central rim of cage 1**.

The movable U-shaped part of the suspension hook comprises an arm 17 which is articulated by an integral or "thin film" hinge 18, obtained by moulding, on the fixed part formed by the connection sleeve 10. Hinge 18 defines for the U section of the hook an articulation axis which is substantially parallel to the axis of cage 1 when the latter is assembled with the hook. The other parallel arm 19 of the U section of the hook is connected to the connection sleeve 10 by a tear off attachment (not shown) formed during moulding; the user can easily remove this attachment when the support is hung on the rim of a toilet pan. The presence of this attachment joining what will, in use, be the free end of the arm 19 of the U section of the hook to the connection sleeve 10 allows any tangling or interlocking of the suspension hooks amongst themselves to be avoided when they are transported in bulk in packing cartons.

It shall be duly understood that the embodiment described above is in no way restrictive and may give rise to any desirable modifications without thereby departing from the scope of the invention as defined by the claims.

I claim:

1. A support for a block of a product for the disinfection and/or deodorisation of a toilet bowl comprising: (a) a foraminous cage for holding a block of said product and having plural openings in its wall; (b) hook means attached to the cage in the central zone thereof to enable the cage to be suspended on the edge of a toilet bowl; (c) connection sleeve means integrally formed with said hook means and adapted to be fitted on to the assembled cage; and (d) means for securing said connection sleeve means to the cage; wherein said securing means comprise (da) means defining a rim in relief in the central zone of the cage, and (db) catch engagement means provided in relief on the inner wall of said connection sleeve means to engage within any one of said plural openings in the foraminous wall of the cage and shaped to allow the connection sleeve means to slide along the cage in one axial direction but to hold the connection sleeve means against movement along the cage in the opposite direction.

2. A support according to claim 1, wherein the cage is substantially cylindrical and said rim means provided on the cage for the connection sleeve means extends peripherally in a central transverse plane of the said cylindrical cage.

3. A support according to claim 2, wherein the cage is constituted by two cage half portions whose plane of juncture corresponds substantially to the central transverse plane of the cage.

4. A support according to claim 3, wherein said cage half portions each have an end collar at an open end thereof, and said peripheral rim means includes the two respective end collars of the assembled cage half portions.

5. A support according to claim 3 or 4, wherein the foraminous wall of each cage half portion comprises an array of bars all arranged parallel to the longitudinal axis of the cage and coaxial rings arranged perpendicular to said longitudinal axis; and wherein said catch engagement means of the connection sleeve means comprise at least one ramp capable, when the connection sleeve means is positioned on the cage, of being engaged in any of said openings which is bounded by the end collar of one cage half portion and by that one of said rings which is adjacent to it.

6. A support according to claim 3 or 4, wherein the two cage half portions are identical and each have connecting means comprising: attachment fingers on each said cage half portion and engagement hooks on said attachment fingers, and means defining an equal number of cutouts on each said cage half portion, said cutouts having a shape complementary to said engagement hooks and being arranged on the inner wall of the end collar of each said cage half portion.

7. A support according to claim 6, wherein said cage half portions each have an open end and an end collar at said open end; wherein said peripheral rim means includes the two respective end collars of the assembled cage half portions; and wherein each cage half portion includes said attachment fingers and cutouts in alternating arrangement regularly interspaced around the circumference of each said end collar.

8. A support according to claim 3 or 5, wherein the two cage half portions are identical and each comprises self-locking attachment fingers for engaging the other of said cage half portions such that each attachment finger of one of the cage half portions engages between two adjacent attachment fingers of the other cage half portion.

9. A support according to any one of claims 1 to 3, wherein said hook means is a U-shaped part having two arms joined by a central bent portion, and wherein a moulded film hinge connects one of said arms movably to the connection sleeve means.

10. A support according to claim 9, and including moulded rupturable attachment means connecting the other of said arms of the U-shaped part to the connection sleeve means.

11. A support according to claim 1 wherein, said sleeve means includes means for engaging said rim means to limit the extent of movement of said sleeve means along the cage in said one axial direction.

12. A support according to claim 11 wherein said sleeve means encircles said rim means in a fully seated position thereof on the cage.

* * * * *